US005601877A

United States Patent [19]

Miller et al.

[11] Patent Number: 5,601,877

[45] Date of Patent: Feb. 11, 1997

[54] METHOD OF SEAM CLOSURE FOR SHEET TRANSFER AND OTHER PAPER PROCESSING BELTS

[75] Inventors: Lawrence G. Miller, Raynham; Robin Lotti-Fassnacht, Marshfield; Henry M. Cooke, Randolph, all of Mass.

[73] Assignee: Albany International Corp., Albany, N.Y.

[21] Appl. No.: 257,565

[22] Filed: Jun. 9, 1994

[51] Int. Cl.[6] ..... D03D 3/04

[52] U.S. Cl. ..... 427/373; 427/389.8; 428/308.4; 139/383 AA; 139/116.1; 139/35; 162/902; 245/10

[58] Field of Search ..... 139/383, 116.1, 139/35; 162/902; 428/229, 257, 258, 308.4; 245/10; 427/373, 389.8

*Primary Examiner*—Richard Weisberger
*Attorney, Agent, or Firm*—Kane, Dalsimer, Sullivan, Kurucz, Levy, Eisele and Richard, LLP

[57] ABSTRACT

A method for closing a seam in a paper processing belt having a coating of polymeric resin material requires the use of a viscous paste obtained by mixing a polymeric resin material with a blowing agent. Following installation of the fabric, or belt, on a paper machine by closing its pin seam with a pintle, the seam region on the non-paper side of the fabric or belt is impregnated with the viscous paste. The seam region is then heated to a temperature to activate the blowing agent and to create a foam from the paste. The foam fills voids in the seam region, and may pass out through the slit in the coating over the seam. Raising the temperature further cures the foam and may glue the slit closed. The belt so seamed may be used as a transfer belt or long nip press (LNP) belt, or in other paper processing applications.

22 Claims, 4 Drawing Sheets

METHOD OF SEAM CLOSURE FOR SHEET TRANSFER AND OTHER PAPER PROCESSING BELTS

BACKGROUND OF THE INVENTION

1. Field of the Invention

The present invention relates to a paper processing belt used to carry out the transfer of a paper sheet between sections, or between elements of a section, such as the individual presses in a press section, of the paper machine on which it is being manufactured, or to carry the sheet into other processes. Specifically, the present invention is a transfer belt which may be joined into endless form during its installation on a paper machine with a seam, and a method for closing the seam region after the coated seamed transfer belt has been so joined.

2. Description of the Prior Art

At present, the only commercially available paper processing belt of this type is a transfer belt. A transfer belt is designed both to carry a paper sheet through a portion of a paper machine, so as to eliminate open draws from the machine and to release the sheet readily to another fabric or belt at some desired point. By definition, an open draw is one in which a paper sheet passes without support from one component of a paper machine to another over a distance which is greater than the length of the cellulose fibers in the sheet and is susceptible to breakage. The elimination of open draws removes a major cause of unscheduled machine shut-down, the breakage of the sheet at such a point where it is temporarily unsupported by a felt or other sheet carrier. When disturbances in the flow of paper stock occur, the likelihood of such breakage is quite strong where the unsupported sheet is being transferred from one point to another within the press section, or from the final press in the press section to the dryer section. At such points, the sheet usually is at least 50% water, and, as a consequence is weak and readily broken. Clearly, the presence of an open draw will place a limitation on the maximum speed at which the paper machine may be run.

A successful sheet transfer belt must carry out three critical functions on the paper machine: a) to remove the paper sheet from a press fabric without causing sheet instability problems; b) to cooperate with a press fabric in one or more press nips to ensure optimal dewatering and high quality of the paper sheet; and c) to transfer the paper sheet in a closed draw from one press in the press section to a sheet-receiving fabric or belt in the next press, or presses, in the press section, or to a dryer pick-up fabric in the dryer section.

A sheet transfer belt which successfully carries out these critical functions is shown in U.S. Pat. No. 5,298,124, entitled "Transfer Belt" and issued on Mar. 29, 1994, the teachings of which are incorporated herein by reference. The transfer belt shown therein has a surface topography characterized by a pressure-responsive, recoverable degree of roughness, so that, when under compression in a press nip, the degree of roughness will decrease, thereby enabling a thin continuous water film to be formed between the transfer belt and a paper sheet to bond the paper sheet to the transfer belt upon exit from the press nip. When the original degree of roughness is recovered after exit from the nip, the paper sheet may be released by the transfer belt, perhaps with the assistance of a minimum amount of vacuum, to a permeable fabric, such as a dryer pick-up fabric.

The sheet transfer belt shown in that application comprises a reinforcing base with a paper side and a back side, and has a polymer coating, which includes a balanced distribution having segments of at least one polymer, on the paper side. The balanced distribution takes the form of a polymeric matrix which may include both hydrophobic and hydrophilic polymer segments. The polymer coating may also include a particulate filler. The reinforcing base is designed to inhibit longitudinal and transverse deformation of the transfer belt, and may be a woven fabric, and further may be endless or seamable for closing into endless form during installation on the paper machine. In addition, the reinforcing base may contain textile material, and may have one or more fiber batt layers attached by needling onto its back side. By textile material is meant fibers and filaments of natural or synthetic origin, intended for the manufacturing of textiles. The back side may also be impregnated and/or coated with polymeric material.

To date, such sheet transfer belts have been produced for paper mills in endless form, that is, having reinforcing bases either woven in endless form or joined into endless form prior to being coated with the polymer material. The installation of an endless transfer belt on a paper machine, however, is a time-consuming and technically complicated endeavor. It goes without saying that paper production must temporarily cease while the transfer belt installation, or replacement, proceeds. Because the installation of an endless belt cannot be accomplished by snaking or threading the belt through and around the components of the paper machine, it must be inserted from the side of the machine. This necessarily is much more time- and labor-intensive than the installation of an open-ended belt, as machine components, such as press rolls, must be supported while the transfer belt is slipped into the spaces between them from the side. Needless to say, the provision of a sheet transfer belt which may be seamed on the machine would significantly reduce the time and labor required to install, or replace, one on a paper machine.

International Publication No. WO 93/17161, disclosing International Application No. PCT/SE93/00173, shows a joinable band comprising a textile web which is provided from at least one side and through at least part of its thickness with a quantity of thermoplastic material. When heat-softened, the thermoplastic material will fill out the fabric structure of the web at least partially. The edges of respective ends of the band have joining eyelets, which are formed in the textile web and which coact with joining eyelets similarly formed in a meeting end of the band so as to form a detachable join. In order to enable the band to be fitted easily to a machine and to provide the region of the band join with the same properties as the remainder of the band, no plastic filler is applied to the textile web joining means along a region whose width extension calculated from end edge and inwardly of the web corresponds at least to the extension of the eyelets over that part which coacts with the eyelets of the meeting web end.

The difficulty associated with the provision of an open-ended, or seamable, transfer belt is the marking likely to be left on the paper sheet by the seam region. Because the sheet transfer belt carries a paper sheet through a press nip, and is in direct contact with the paper sheet therein, the slightest difference in caliper, compressibility and surface hardness of the seam region of the belt will leave a mark on the sheet.

Accordingly, the principal object of the present invention is to provide a seamable sheet transfer belt, and a method for making the same, wherein the seam region thereof has properties substantially identical to those of the remainder of the sheet transfer belt, so that the seam region may not mark the paper sheet.

It is also an object of the present invention to provide a seamable sheet transfer belt, so that the time and labor required to install or replace such a belt on a paper machine may be reduced.

It is a further object of the present invention to provide a seamable sheet transfer belt, so that existing paper machines may be more readily modified, or adapted to incorporate, the sheet transfer belt shown in U.S. Pat. No. 5,298,124, whereby open draws may be eliminated therefrom.

SUMMARY OF THE INVENTION

Accordingly, the present invention comprises a method for closing the seam area of a coated seamed belt after it has been rejoined into endless form on a paper machine. The objective of the invention is to totally seal the seam while providing it with the same compressive properties as the remainder of the belt under normal nip loads. The sealing technique also distributes the bending stress which would otherwise be concentrated at the coating join line. This improves the flex fatigue resistance of the join.

Briefly, the prepared seam area of the belt is filled from the non-paper side using a foam of a polymeric material. If necessary, the paper side of the belt may be filled using the same or a different polymeric material, not necessarily a foam. In one method, the foam compound is blown and cured under contact pressure using a heating source with platens and a suitable release medium. During the heating operation, the foam compound expands and fills all voids, including the coating join line. After curing, the heater is removed and the coated surface is finish ground, as necessary, to remove flash. The foam chemistry and the geometry of the heater platens determines the overall compressibility of the seam area in the nip.

The coated belt has a construction whereby the seam loops may be positioned in the center of the structure below the coating and above a back layer, which may include a woven fabric, a needled web of fibrous batt material, a polymeric foam, a coating of a polymeric resin material or other nonwoven structures, or any combination thereof.

More specifically, the method of the present invention for closing a seam in a polymeric-resin-coated paper processing belt comprises joining a pin-seamable papermaker's fabric into endless form with a pintle, and coating the outer surface (paper side) of the fabric with a polymeric resin material. Following the curing of the polymeric resin material, and optional surface finishing, the pintle is removed, and the polymeric resin material cut over the seam to leave the now-coated fabric in open-ended form. The belt is then shipped to a paper mill where it is rejoined into endless form with a pintle during installation on a paper machine. The seam is then impregnated from at least one side of the belt, that is, at least from the inner surface (non-paper side) with a viscous paste comprising a polymeric material and a blowing agent. The seam is then gradually heated to a temperature at which the blowing agent decomposes to release a gas, producing a foam from the viscous paste. The foam fills the voids in the seam, and may pass through the slit formed when the coating material was cut. The seam is then heated further to the curing temperature of the foam. The curing may glue the slit closed, or it may be glued closed with a separate material.

The present invention also includes a belt made in accordance with the method. While emphasis is given in the discussion to follow, to the seaming of a sheet transfer belt, the invention may also be applied to the seaming of a long nip press (LNP) belt or of any other polymer coated belt for the paper industry.

The present invention enables those skilled in the paper machine clothing arts to control seam compressibility to eliminate, or, at least, to minimize, sheet marking in the nip. A further advantage of the present invention is that distribution of the foam on the underside of the belt in the seam area reduces the stress forces at the coating join. Finally, sealing the coating join may prevent water penetration and possible premature failure of the belt due to coating delamination. It can also reduce sheet marking caused by the join line of the coating.

The present invention will now be described in more complete detail with reference frequently being made to the figures identified as set forth below.

DETAILED DESCRIPTION OF THE PREFERRED EMBODIMENT

Figure 1:
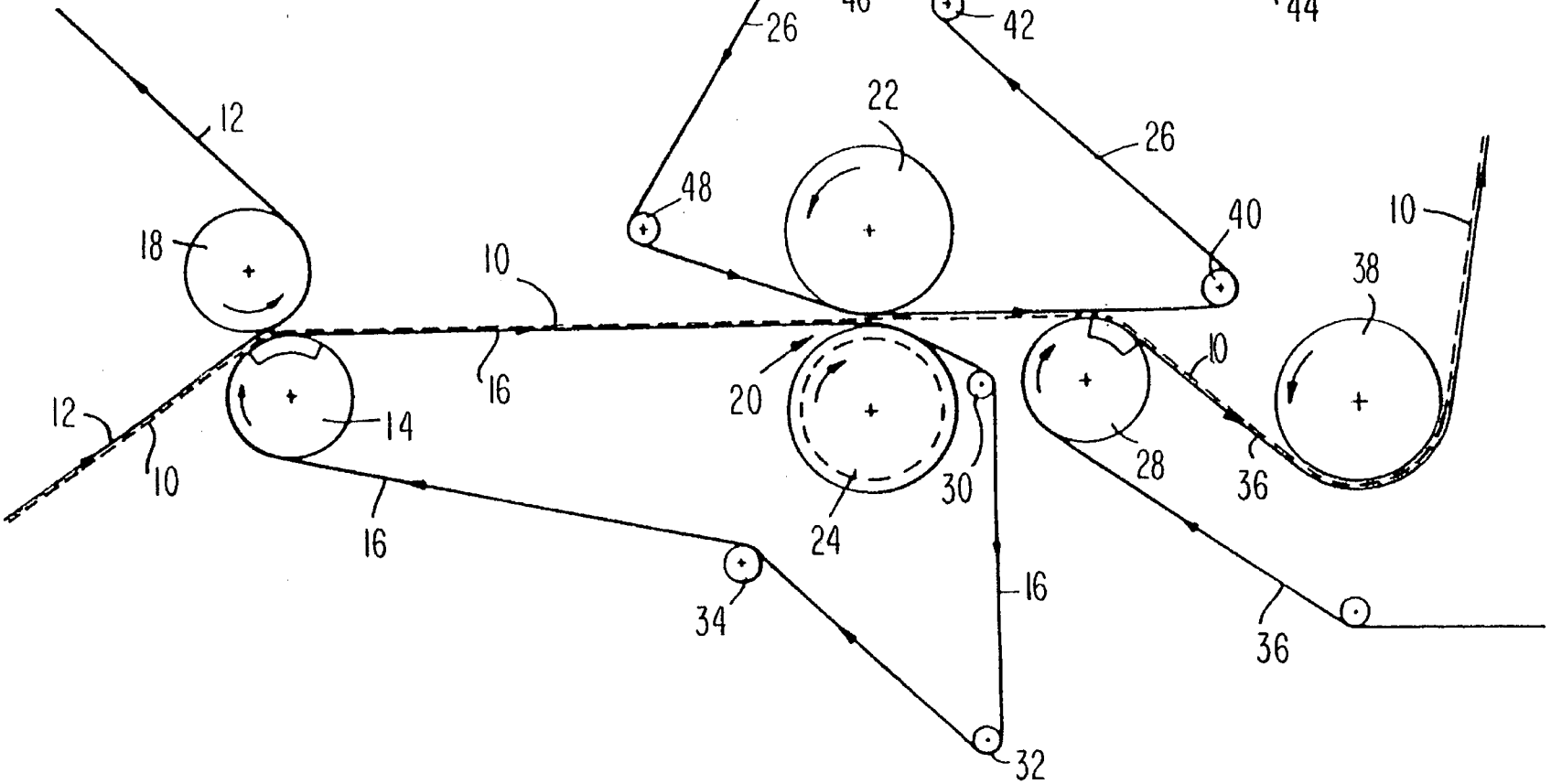
FIG. 1 shows a representative press arrangement including a transfer belt for eliminating an open draw in a paper machine.

A representative press arrangement which includes a transfer belt for eliminating an open draw in a paper machine is shown, for purposes of illustration and general background, in FIG. 1. The arrows in FIG. 1 indicate the directions of motion or rotation of the elements shown therein.

In FIG. 1, a paper sheet 10, represented by a dashed line, is being carried toward the right initially on the underside of a pick-up fabric 12, which pick-up fabric 12 has previously taken the paper sheet 10 from a forming fabric, not shown.

The paper sheet 10 and pick-up fabric 12 proceed toward a first vacuum transfer roll 14, around which is trained and directed a press fabric 16. There, suction from within first vacuum transfer roll 14 removes paper sheet 10 from pick-up fabric 12 and draws it onto press fabric 16. Pick-up fabric 12 then proceeds from this transfer point, toward and around a first guide roll 18, and back, by means of additional guide rolls not shown, to the point where it may again receive the paper sheet 10 from a forming fabric.

Paper sheet 10 then proceeds, carried by press fabric 16, toward a press nip 20 formed between a first press roll 22 and a second press roll 24. Second press roll 24 may be grooved, as suggested by the dashed line within the circle representing it in FIG. 1, to provide a receptacle for water removed in the press nip 20 from the paper sheet 10. A transfer belt 26 is trained around first press roll 22, and is directed through press nip 20 with paper sheet 10 and press fabric 16. In the press nip 20, the paper sheet 10 is compressed between the press fabric 16 and the transfer belt 26.

On exiting press nip 20, paper sheet 10 adheres to the surface of the transfer belt 26, whose surface is smoother than that of the press fabric 16. Proceeding toward the right in the figure from press nip 20, paper sheet 10 and transfer belt 26 approach a second vacuum transfer roll 28. Press fabric 16 is directed by means of second guide roll 30, third guide roll 32 and fourth guide roll 34, back to first vacuum transfer roll 14, where it may again receive paper sheet 10 from pick-up fabric 12.

At second vacuum transfer roll 28, paper sheet 10 is transferred to a dryer fabric 36, which is trained and directed thereabout. Dryer fabric 36 carries paper sheet 10 toward the first dryer cylinder 38 of the dryer section.

The transfer belt 26 proceeds onward to the right in the figure away from second vacuum transfer roll 28 to a fifth guide roll 40, around which it is directed to a sixth guide roll 42, a seventh guide roll 44, an eighth guide roll 46, and a ninth guide roll 48, which eventually return it to the first press roll 22 and to the press nip 20, where it may again accept the paper sheet 10 from the press fabric 16.

As may be observed in FIG. 1, the transfer belt 26 also eliminates open draws in the press arrangement shown, most particularly, the open draw often present where the paper sheet 10 is transferred from the press fabric 16 to the dryer fabric 36. Paper sheet 10 is supported at all points in its passage through the press arrangement shown in FIG. 1 by a carrier. In addition, it should be noted that the paper sheet 10 is carried on the underside of the transfer belt 26 upon exiting from the press nip 20, because the water film on the transfer belt 26 is strong enough to hold the paper sheet 10.

To produce the seamed transfer belt of the present invention, one starts by obtaining a coating base of the OMS (on-machine-seamable) variety, and by temporarily joining it into endless form, the inner surface of the endless loop so formed being the non-paper side of the transfer belt. A view of the seam region of such a press fabric is included in FIG. 2.

Figure 2:
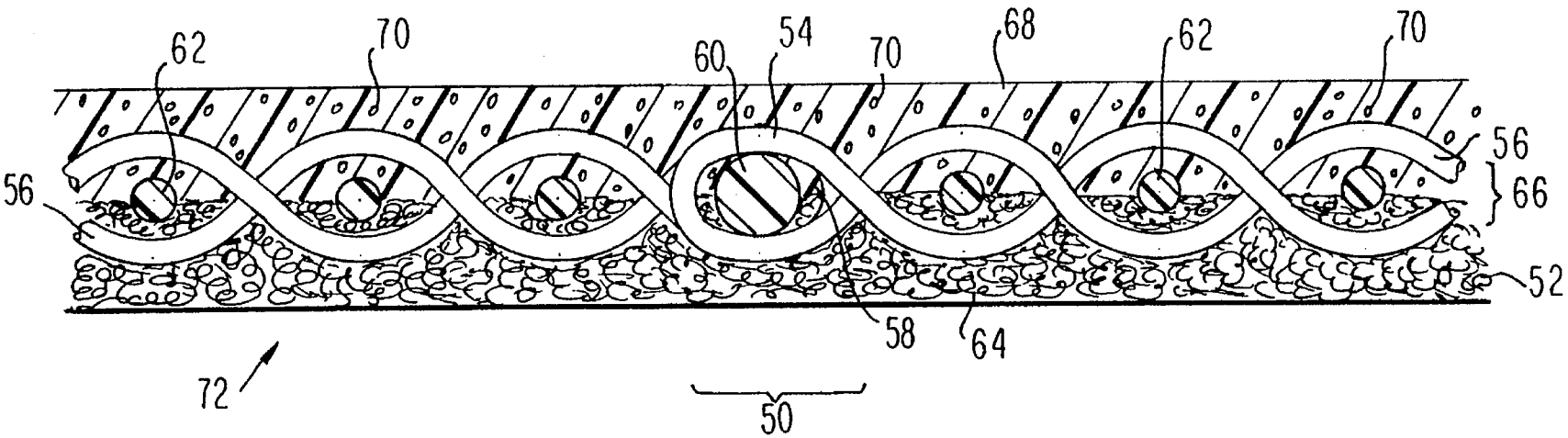
FIG. 2 shows a cross-sectional view of a polymeric-resin-coated paper processing belt at a point during its manufacture.

Referring specifically to FIG. 2, the seam region 50 of the seamed OMS coating base 52 comprises seaming loops 54, formed by machine-direction yarns 56 at the widthwise edges of the open-ended press fabric 52. When such a coating base 52 is to be closed into endless form, the two ends are brought together, the seaming loops 54 at the ends are interdigitated with one another to form a passage 58, and a pintle 60 is directed through the passage 58 to interlock seaming loops 54 together. The pintle 60 may be a coarse monofilament as shown in FIG. 2. Alternatively, pintle 60 may be a multifilament pintle or a plied monofilament pintle.

FIG. 2 shows one type of coating base 52 that may be used. This coating base 52 includes cross-machine direction yarns 62 and fibrous batt material 64 needled into the base fabric 66 formed by the interwoven machine-direction yarns 56 and cross-machine direction yarns 62. Alternatively, instead of or along with fibrous batt material 64, the back layer of the coating base 52 may include a woven fabric, a polymeric foam, a coating of a polymeric resin material, either the same as or different from that used on the paper side of the coating base 52, or other nonwoven structures, or any combination thereof.

As noted above, the coating base 52 is temporarily joined into endless form, the outer surface of the endless loop so formed being the paper side of the transfer belt, on a suitable apparatus at the production facility, such that it may be placed under an amount of longitudinal tension analogous to that which it supports when running on a paper machine.

In such a condition, the outside of the closed loop formed by the coating base 52 is coated with polymer coating 68, which includes a balanced distribution with segments of at least one polymer, forming a polymeric matrix which may include both hydrophobic and hydrophilic polymer segments. The polymer coating 68 may also include a particulate filler 70, as disclosed in U.S. Pat. No. 5,298,124.

The coating 68 is then cured and subsequently ground to provide the transfer belt 72, including seam region 50, with uniform thickness and with a desired surface topography.

At this point, the transfer belt 72 may be inverted (turned inside-out) if its length and width permit this to be done without causing any damage thereto. Alternatively, the operation to be described next may be carried out from within the closed loop formed by the transfer belt 72, so long as means for disposing the worker to carry out the operation therewithin without damaging the transfer belt 72 are provided.

Figure 3:
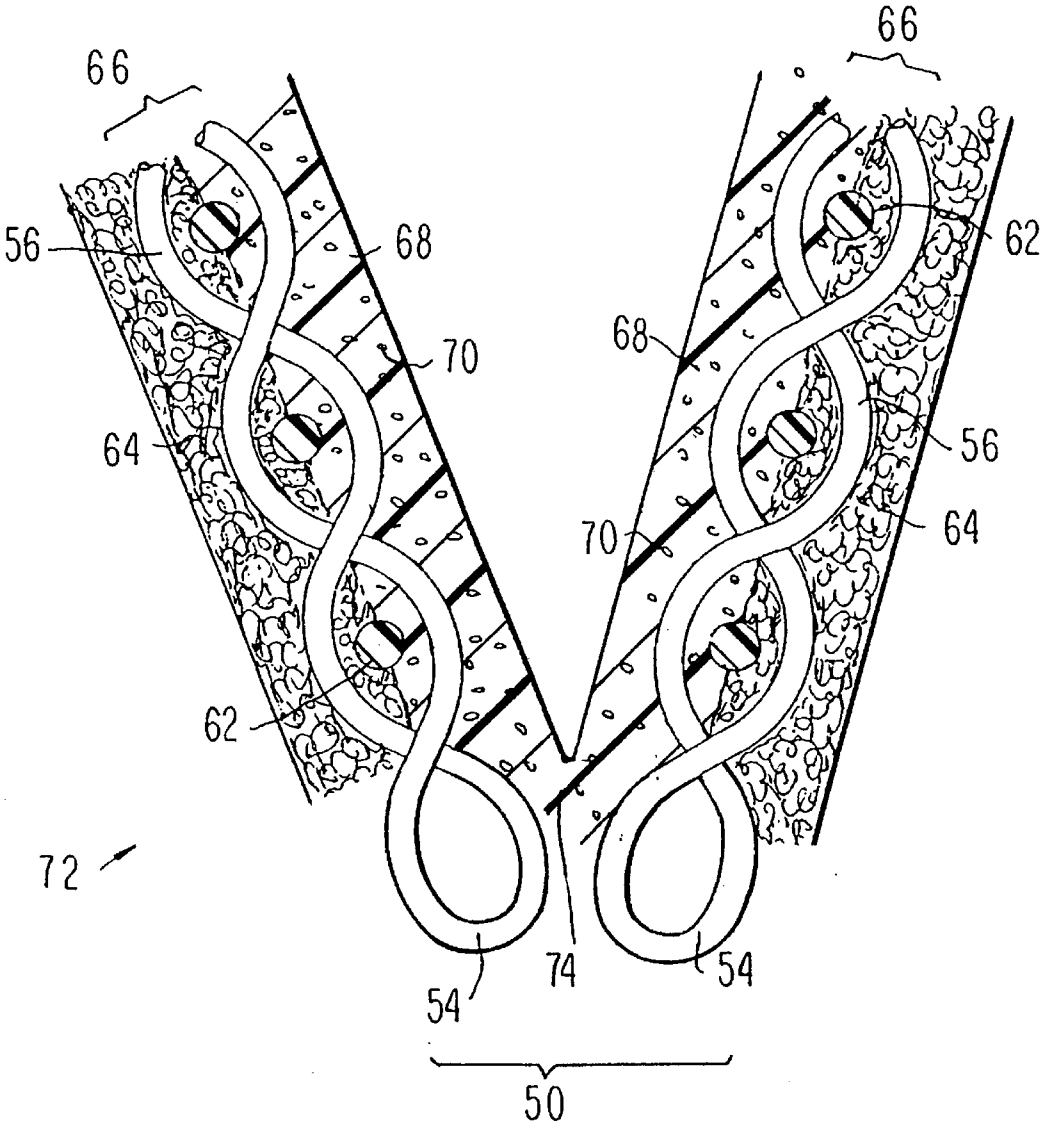
FIG. 3 shows a cross-sectional view of the polymeric-resin-coated paper processing belt at a subsequent point during its manufacture.

In either case, the pintle 60 is removed, and the transfer belt 72 folded at the seam region 50 as shown in FIG. 3. That is to say, the transfer belt 72 is folded in such a manner that the coating 68 is on the inside of the fold. The act of folding removes the seaming loops 54 from their interdigitated state, and brings them into a configuration that may be described as two spaced parallel rows of upstanding seaming loops 54. Between the two parallel rows is a portion 74 of the coating 68. That portion 74 is cut by running a sharp implement between the two parallel rows of seaming loops 54 to return the transfer belt 72 to open-ended form, without cutting any of the seaming loops 54.

In this open-ended form, the transfer belt 72 is packaged, and shipped to a paper mill for installation in the paper machine, such as that illustrated in FIG. 1, in the same manner as an OMS press fabric may be installed. It will be recalled that in FIG. 1, the transfer belt was identified with reference numeral 26.

Referring back to FIG. 1, the seamable transfer belt 72 is installed on the paper machine instead of endless transfer belt 26 with the polymer coating 68 facing outwardly. A yarn more pliable than coarse monofilament pintle 60 may be used as the final pintle. It now remains to ensure that the seam region 50, and, specifically, that portion 74 of the polymer coating 68 which was cut to make the transfer belt 72 open-ended, does not mark the paper sheet 10 being manufactured on the paper machine.

Figure 4:
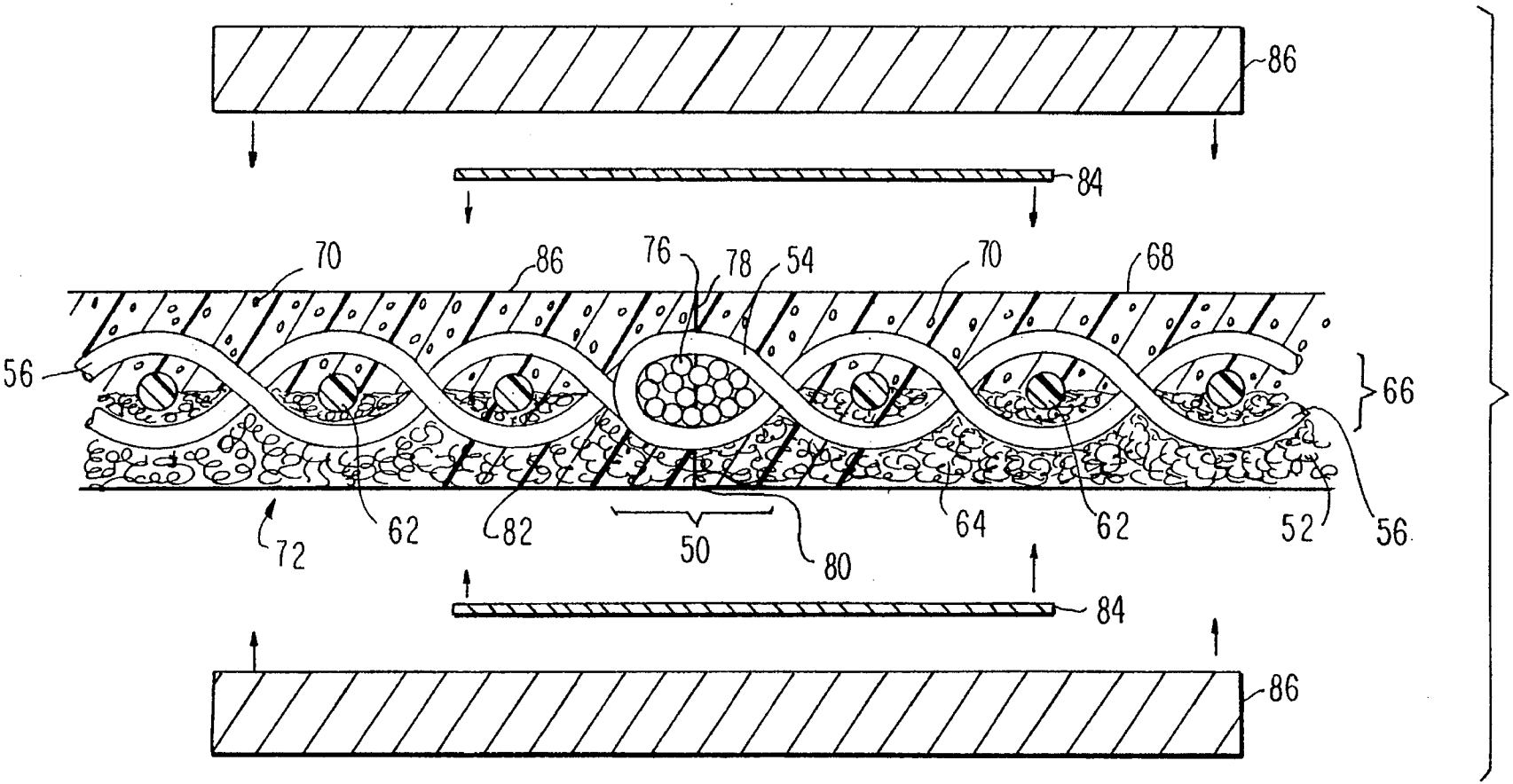
FIG. 4 illustrates the method by which the seam may be closed following the installation of the polymeric-resin-coated paper processing belt on a paper machine and is a cross-sectional view of the belt at that time.

With reference to FIG. 4, the seam region 50 of seamable transfer belt 72 appears as shown therein when a pintle 76 is used to rejoin it into endless form on a paper machine. A slit 78 remains in the polymer coating 68 more or less directly over the seaming loops 54, and, less seriously, a break 80 remains in the fibrous batt material 64 directly below the seaming loops 54. The loop/pintle combination makes the seam region 50 slightly different from the rest of the seamable transfer belt 72, and raises the possibility that the seam region 50 might mark a paper sheet with which it comes into contact.

Pintle 76 may be a coarse monofilament pintle, a multifilament pintle, a plied multifilament pintle, a plied monofilament pintle, or a composite pintle including any of these varieties of pintle.

A foam produced by mixing a fluid polymeric resin material with a blowing agent to form a viscous paste, and by subsequently heating and curing the viscous paste, is used to fill and to cement the seam region 50 and slit 78. A solvent-free urethane composition, such as Adiprene L-100 from Dupont, or one based on a polyether-type prepolymer, may be used for this purpose. The following is an example of a solvent-free urethane composition that may be used for this purpose.

| Component | Weight (%) |
|---|---|
| Polyether/TDI polyurethane prepolymer (4.1% NCO) | 76.9 |
| Blocked aromatic amine (equivalent weight - 217) | 15.4 |
| Endothermic nucleating agent (blowing agent) | 7.7 |

Other components such as fillers, plasticizers, and catalysts may be added as needed. The blowing agent, typically a solid particulate material which decomposes to release a gas almost instantaneously when heated to a characteristic temperature, is mixed with the liquid polymeric resin material. The temperature at which the blowing agent activates is typically less than the temperature at which the polymeric resin material cures. For example, the temperature at which the blowing agent decomposes (or blows) may be 115° C., while the temperature at which the polymeric resin material cures may be 130° C., which is the relevant temperature for Adiprene L-100. The blowing agent causes the viscous paste to foam and to expand, filling voids in the seam region 50, and may even pass through the slit 78. In such a manner, the slit 78 may be glued together, and the seam region 50 may be left with the same compressibility and caliper as the rest of the transfer belt 72.

The viscous paste producing foam 82 is preferably applied first to the non-paper side, or inside, of the seam region 50 of the transfer belt 72 at a point on the paper machine affording ready access to paper mill personnel. For example, the area adjacent to seventh guide roll 44 included in FIG. 1 may afford such ready access. The viscosity of the viscous paste producing foam 82 is preferably adjusted, so that it may be easy to apply regardless of the orientation (horizontal, vertical, upside-down, etc.) of the surface to be coated.

Preferably, the viscous paste may be applied to the seam region 50 of the non paper side of the transfer belt 72 for a distance, such as 0.25 inch (0.64 cm), on both sides of the seam, so that the bending stress may be distributed across the seam region 50, rather than concentrated in one place, such as slit 78.

Once the seam region 50 on the non-paper side of the seamable transfer belt 72 has been covered with the viscous paste, it may be covered with a material 84 to which the cured foam 82 (obtained from the viscous paste) does not stick, such as heat-resistant release paper, teflon-coated fiberglass tape, and other materials.

The paper-side surface of the seam region 50 of the seamable transfer belt 72 may also be coated with the viscous paste which produces foam 82, or may optionally be coated with another polymeric coating material, such as that used to provide coating 68, to fill in any cracks in the slit 78. Similarly, once the seam region 50 on the paper side of the seamable transfer belt 72 has been coated in either manner, it may be covered with a material 84 to which the cured foam 82 (obtained from the viscous paste) or other polymeric coating material does not stick.

A heat source may be used to foam the viscous paste and to cure the foam 82. For example, heat strips 86 may be fashioned from blocks of aluminum having a nominally 0.5 inch thickness, and a width sufficient to completely span the seam region 50 in the belt-running direction. The heat strips 86 include a heating element by which they may be brought gradually from ambient temperature up to and above the temperature at which the foam cures.

The two heat strips 86 are pressed against the two sides of the seam region 50, so that the caliper of the seam region 50 may be the same as that of the rest of the transfer belt 72. In such position, the heat strips 86 are allowed to rise in temperature from ambient to the blowing temperature, at which the blowing agent included in the viscous paste decomposes and blows the paste, forcing it into voids in the seam region 50. The heating of the heat strips 86 continues above this blowing temperature to the curing temperature of the polymeric resin material, which may cure almost instantaneously at that temperature. Preferably, the curing temperature is maintained for a time sufficient to ensure that the curing process is completed.

A viscous paste with a very long pot life at room temperature may be used, so that one could work step-by-step across a seam in the case where the seam is not exactly transverse across the belt. A long pot life implies that the paste material may be kept for a long time without its properties changing. If the paste material has a long pot life, the heat strips 86 need not be as wide as the transfer belt 72, and, as stated above, one could work step-by-step across the seam to seal it in the manner of the present invention.

After curing, any material 84 applied to the non-paper side and/or paper side of the seam region 50 is removed, and the transfer belt 72 may be moved so that the seam region 50 is on a roll, such as seventh guide roll 44 in FIG. 1. There, the surface of polymeric coating 68 may be smoothed by light sanding to remove any seam filling material protruding from the seam area.

As noted above, the slit 78 may alternatively be glued with a separate material. The following is an example of a formulation that may be used as the separate material:

| Component | Weight (%) |
|---|---|
| Polyether/TDI polyurethane prepolymer (4.1% NCO) | 76.9 |
| Blocked aromatic amine (equivalent weight - 217) | 15.4 |
| Kaolin clay | 7.7 |

Modifications to the above would be obvious to those skilled in the art, and would not bring the invention so modified beyond the scope of the appended claims.

What is claimed is:

1. A method for closing a seam in a polymeric-resin-coated paper-processing belt comprising the steps of:

providing a pin-seamable papermaker's fabric, said fabric having a paper side, a non-paper side and seaming loops at two widthwise edges for forming a seam;

joining said pin-seamable papermaker's fabric into endless form with a first pintle by directing said first pintle through a passage defined when said seaming loops at said two widthwise edges are interdigitated with one another;

coating a side of said papermaker's fabric with a first polymeric resin material;

curing said first polymeric resin material to produce said polymeric resin-coated paper processing belt;

removing said first pintle;

cutting said cured first polymeric resin material at said seam to place said belt in open-ended form;

installing said belt on a paper machine;

joining said belt into endless form with a second pintle by directing said second pintle through a passage defined when said seaming loops at said two widthwise edges of said pin-seamable papermaker's fabric are interdigitated with one another, whereby said first polymeric resin material has a slit adjacent to said seaming loops;

providing a viscous paste including a second polymeric resin material and a blowing agent;

applying said viscous paste to said seam;

causing said blowing agent in said viscous paste to generate gas whereby said viscous paste may become a foam; and curing said foam.

2. The method as claimed in claim 1 wherein said first pintle is a coarse monofilament pintle.

3. The method as claimed in claim 1 wherein said first pintle is a multifilament pintle.

4. The method as claimed in claim 1 wherein said first pintle is a plied monofilament pintle.

5. The method as claimed in claim 1 wherein said second pintle is a coarse monofilament pintle.

6. The method as claimed in claim 1 wherein said second pintle is a multifilament pintle.

7. The method as claimed in claim 1 wherein said second pintle is a plied monofilament pintle.

8. The method as claimed in claim 1 wherein said second pintle is a composite pintle including a coarse monofilament pintle.

9. The method as claimed in claim 1 wherein said second pintle is a composite pintle including a multifilament pintle.

10. The method as claimed in claim 1 wherein said second pintle is a composite pintle including a plied monofilament pintle.

11. The method as claimed in claim 1 wherein said coating step is performed on the paper side of said pin-seamable papermaker's fabric, and further comprising the step of needling said non-paper side of said pin-seamable papermaker's fabric with fibrous batt material.

12. The method as claimed in claim 1 wherein said coating step is performed on the paper side of said pin-seamable papermaker's fabric, and further comprising the step of coating said non-paper side of said pin-seamable papermaker's fabric with said first polymeric resin material.

13. The method as claimed in claim 1 wherein said coating step is performed on the paper side of said pin-seamable papermaker's fabric, and further comprising the step of coating said non-paper side of said pin-seamable papermaker's fabric with a third polymeric resin material.

14. The method as claimed in claim 1 wherein said pin-seamable papermaker's fabric includes machine-direction yarns, and wherein said seaming loops are formed by said machine-direction yarns.

15. The method as claimed in claim 1 further comprising the step of grinding said first polymeric resin material subsequent to said curing step to make said polymeric-resin-coated paper-processing belt uniformly thick and to impart desired surface characteristics thereto.

16. The method as claimed in claim 1 further comprising the step of covering said viscous paste subsequent to said step of applying it to said seam.

17. The method as claimed in claim 1 further comprising the step of applying said viscous paste to said seam on said side of said belt having said coating of first polymeric resin material.

18. The method as claimed in claim 17 further comprising the step of covering said viscous paste subsequent to said step of applying it to said seam.

19. The method as claimed in claim 1 wherein said steps of causing said blowing agent to generate gas and of curing said foam are carried out while compressing said seam, so that said seam may have the same caliper and/or compression properties as the remainder of said polymeric-resin-coated paper-processing belt.

20. The method as claimed in claim 1 further comprising the step of sanding said seam on said side of said polymeric-resin-coated paper-processing belt having said first polymeric resin material to smooth said seam.

21. The method as claimed in claim 1 wherein said step of causing said blowing agent to generate gas to produce a foam from said viscous paste forces said foam into said slit in said first polymeric resin material, and said step of curing said foam causes said slit to be glued together.

22. The method as claimed in claim 1 further comprising the step of applying said viscous paste for a distance on both sides of said seam to cover said seam and a region on both sides thereof, so that bending stresses in said polymeric-resin-coated paper-processing belt may be distributed over a region broader than said seam to relieve said slit from said bending stresses, and so that the region of said seam may have a resistance to bending equivalent to that of the remainder of the belt.

* * * * *